US006315362B1

(12) United States Patent
Chuang

(10) Patent No.: US 6,315,362 B1
(45) Date of Patent: Nov. 13, 2001

(54) HEIGHT ADJUSTMENT MECHANISM FOR CHAIR BACKREST OR ARM

(75) Inventor: Mei-Chin Chuang, Madou (TW)

(73) Assignee: Yi Chun Enterprise Ltd., Madou (TW)

( * ) Notice: Subject to any disclaimer, the term of this patent is extended or adjusted under 35 U.S.C. 154(b) by 0 days.

(21) Appl. No.: 09/894,439

(22) Filed: Jun. 28, 2001

Related U.S. Application Data

(63) Continuation-in-part of application No. 09/860,926, filed on May 18, 2001.

(51) Int. Cl.[7] ..... A47C 7/54
(52) U.S. Cl. ..... 297/411.36
(58) Field of Search ..... 297/353, 411.36, 297/410

(56) References Cited

U.S. PATENT DOCUMENTS 5,265,938 * 11/1993 Melhuish et al. ..... 297/411.36
5,597,204 * 1/1997 Karaus, Jr. ..... 297/411.36
5,895,095 * 4/1999 Chen ..... 297/411.36
6,209,961 * 4/2001 Chen ..... 297/411.36

* cited by examiner

*Primary Examiner*—Peter R. Brown
(74) *Attorney, Agent, or Firm*—Alan Kamrath; Rider, Bennett, Egan & Arundel, LLP

(57) ABSTRACT

An adjustment mechanism mounted in a chair for releasably locking one chair component in one of positions relative to a seat. The mechanism comprises a tube-like brace secured to underside of seat; a sliding member slideable in brace secured to one chair component and having lengthwise recesses; a guide member coupled to sliding member; a hook member having a lower end coupled to guide member and an upper bent end; a first member secured in brace including a notched member having curved members and a channel; and a second member secured in brace together with first member for receiving sliding member and hook member, a spring-loaded detent of second member being secured in a hole and having a portion projected from hole into one recess for engagement in an unused state. One chair component is operative to push down to cause bent end to move through channel in response to a disengagement of detent from one recess and pull up to lock in one of curved members with detent engaged with the other recess.

3 Claims, 5 Drawing Sheets

HEIGHT ADJUSTMENT MECHANISM FOR CHAIR BACKREST OR ARM

CROSS REFERENCE

This application is a continuation-in-part of U.S. application Ser. No. 09/860,926, filed May 18, 2001.

FIELD OF THE INVENTION

The present invention relates to mechanisms for adjusting components of a chair relative to one another, and more particularly to an improved height adjustment mechanism for chair backrest or arm.

BACKGROUND OF THE INVENTION

Conventional height adjustment mechanisms for backrest or arm of a chair are strength dependent and require considerable effort on the part of user to achieve positioning. Further, such prior mechanisms are typically complex in constructions, difficult to assemble, trouble-prone, unreliable, and unsightly. Thus, it is desirable to provide a new and improved height adjustment mechanism for chair backrest or arm in order to overcome the above drawbacks of prior art.

SUMMARY OF THE INVENTION

It is an object of the present invention to provide an adjustment mechanism mounted in a chair for releasably locking one chair component in any one of a plurality of positions relative to a seat of the chair. The adjustment mechanism comprises a tube-like brace having one end secured to underside of the seat; a sliding member slideable in the brace having an upper end secured to one chair component, a lower opening, and a plurality of longitudinally disposed recesses; a guide member coupled to the lower opening of the sliding member; a hook member having a lower end coupled to the guide member and an upper bent end; a first half-cylindrical member secured in the brace including an internal notched member having a plurality of curved members each including a first curve, a stop, and a second curve, and a longitudinal channel in communication with the curved members; and a second half-cylindrical member secured in the brace matingly snapped with the first half-cylindrical member for receiving the sliding member and the hook member, the second half-cylindrical member including a lower hole, a spring-loaded detent having a portion projected from the lower hole into one of the recesses for engaging with the sliding member and other remaining portions concealed in the lower hole in an unused state of the adjustment mechanism, and a fastener secured in the lower hole to compress the spring-loaded detent; wherein one chair component is operative to push down to cause the bent end to move through the channel in response to a disengagement of the detent from the recess and pull up to lock in one of the curved members with the detent engaged with one of the recesses.

In one aspect of the present invention, the fastener is a thumb screw.

In another aspect of the present invention, the detent comprises a steel ball releasably engaged with one of the recesses.

The above and other objects, features and advantages of the present invention will become apparent from the following detailed description taken with the accompanying drawings.

DETAILED DESCRIPTION OF THE PREFERRED EMBODIMENTS

Figure 1:
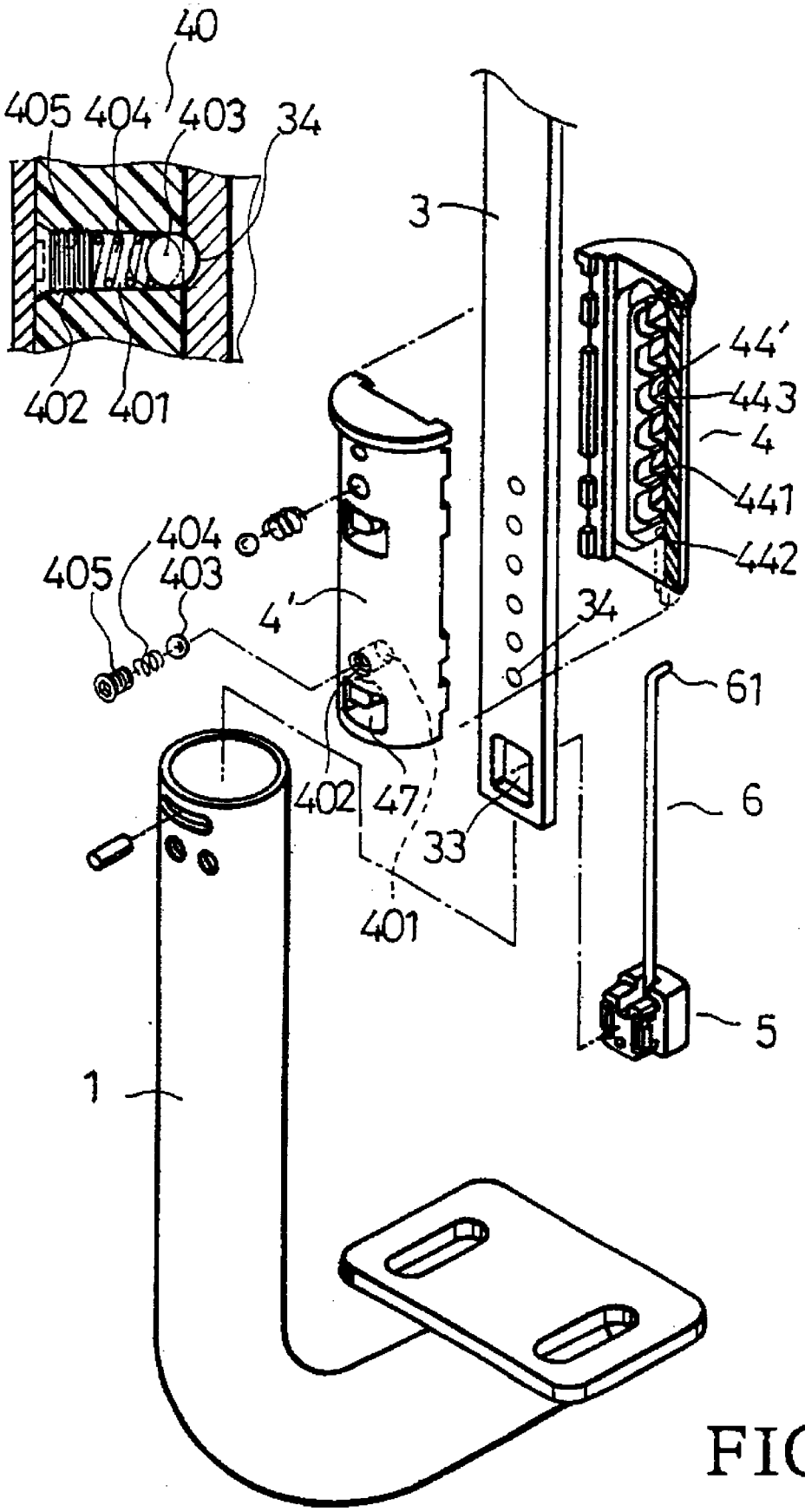
FIG. 1 is an exploded view of a height adjustment mechanism according to the invention mounted in a backrest or arm of a chair.
Figure 2:
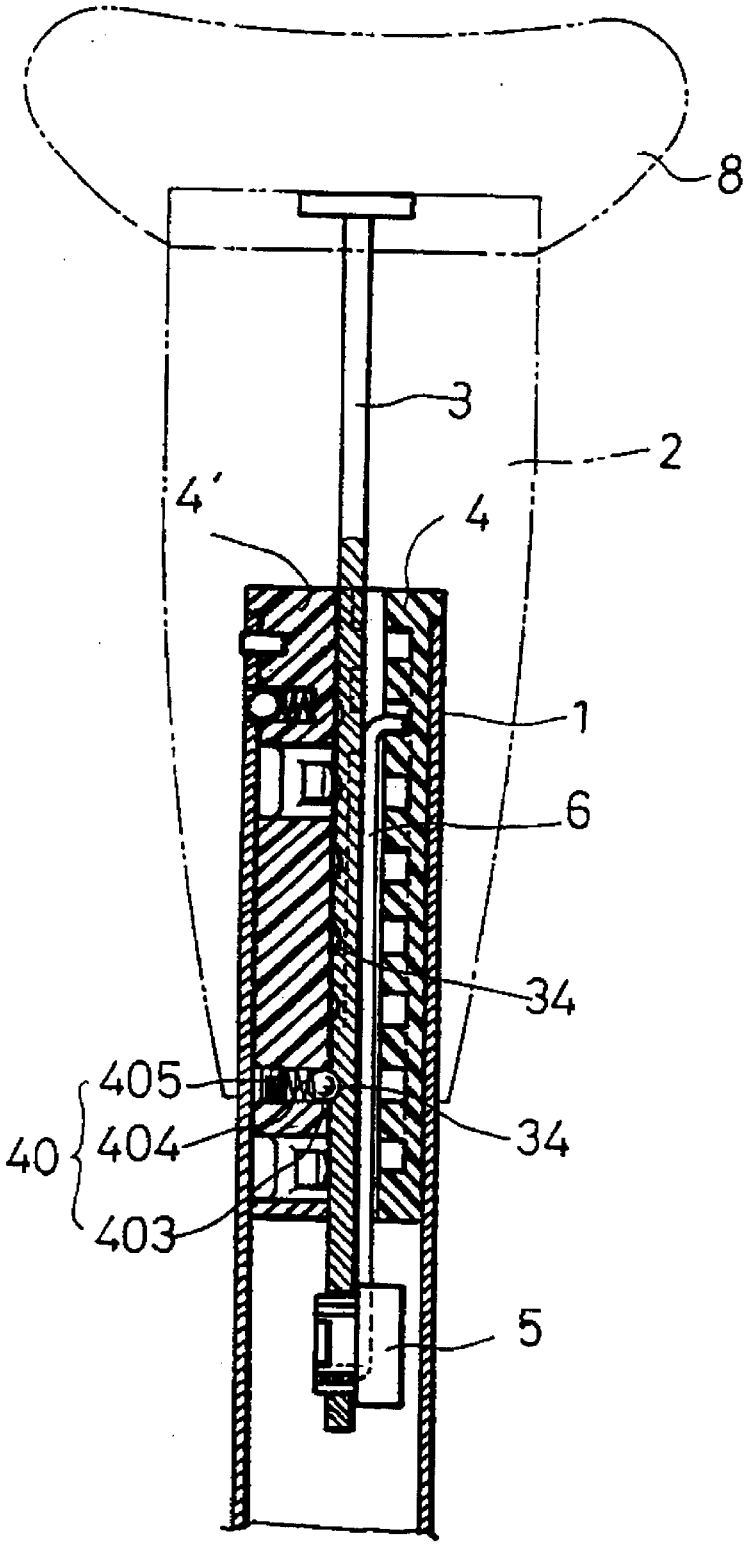
FIG. 2 is a cross-sectional view of the assembled height adjustment mechanism of FIG. 1 mounted in a chair arm.

Referring to FIGS. 1 and 2, there is shown a height adjustment mechanism constructed in accordance with the invention mounted in either a backrest or arm of a chair. The mechanism comprises a tube-like brace (or J-bar) 1 having one end secured to underside of seat; a sliding member 3 slideable in a bore of the brace 1 having an upper end secured to one chair component, a lower opening 33, a plurality of longitudinally disposed recesses 34, and an upper end secured to backrest or arm of chair; a guide member 5 snapped in the lower opening 33 of sliding member 3; a hook member 6 having a lower end coupled to guide member 5 and an upper bent end 61; a first half-cylindrical member 4 secured in the brace 1 including an internal notched member 44' having a plurality of curved members each including a first curve 441, a stop 442, and a second curve 443, and a longitudinal channel 46 in communication with the notched member 44' (FIG. 4); and a second half-cylindrical member 4' secured in the brace 1 matingly snapped with the first half-cylindrical member 4 for receiving sliding member 3 and hook member 6, the second half-cylindrical member 4' including a lower opening 47, a lower hole 401, a spring 404 received in the lower hole 401, a steel ball 403 biased by the spring 404 and having a portion projected from the lower hole 401 into one of recesses 34 and other remaining portions concealed in lower hole 401 in an unused state of the height adjustment mechanism, and a fastener (e.g., thumb screw) 405 threadedly secured in lower hole 401 to compress spring 404.

Figure 3:
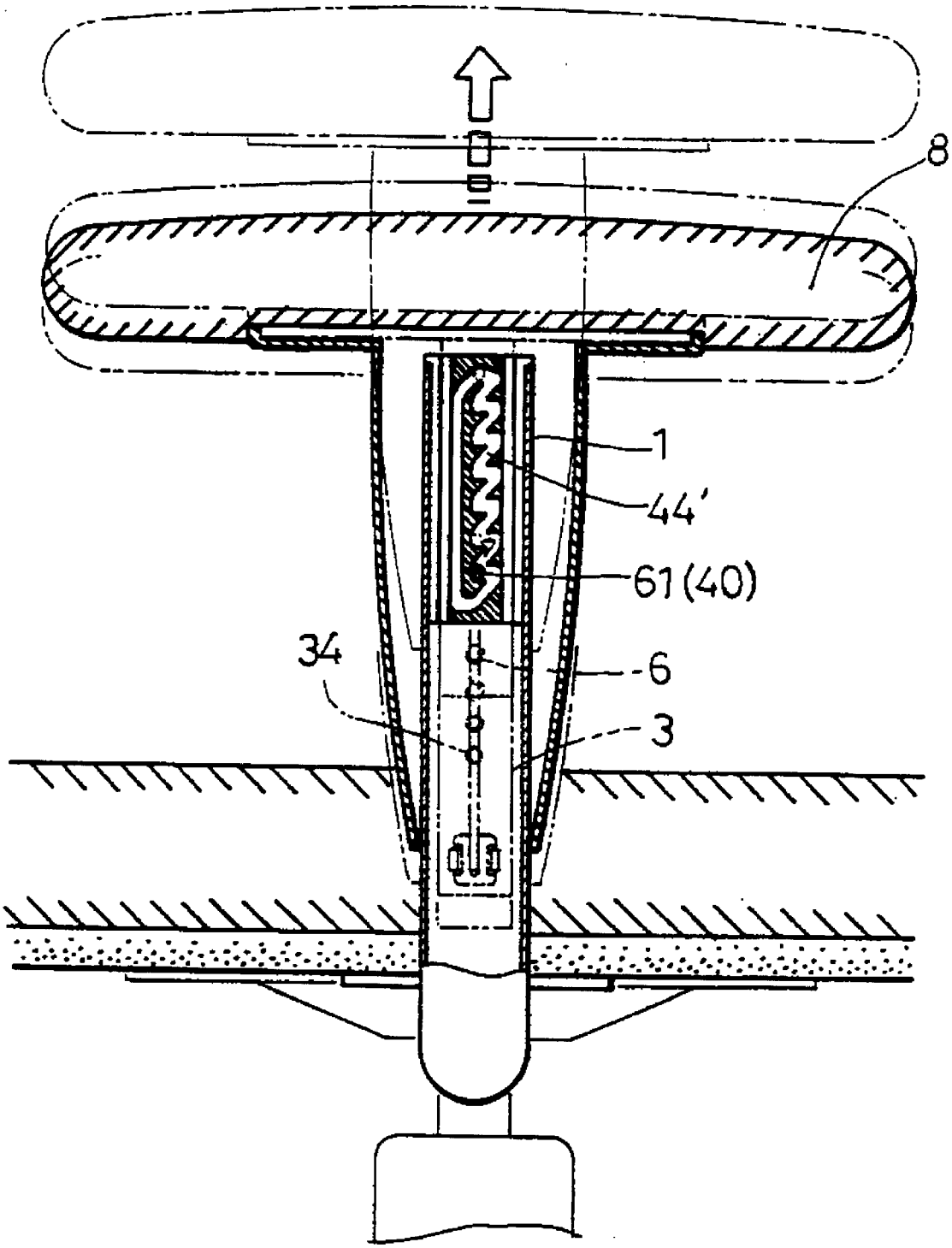
FIG. 3 is another cross-sectional view of the assembled height adjustment mechanism of FIG. 1 where arm has been adjusted to a maximum height.
Figure 4:
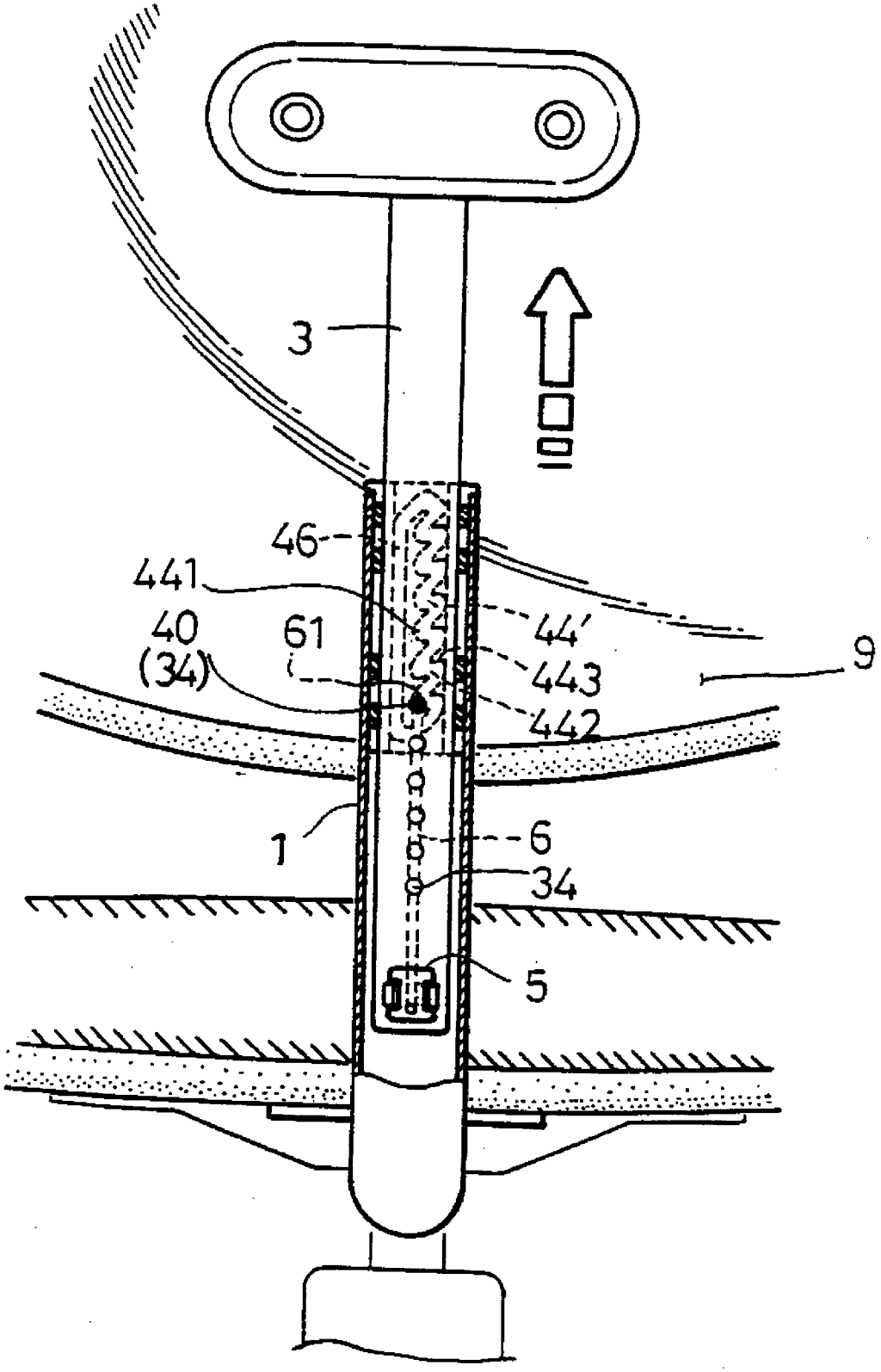
FIG. 4 is a rear plan view in part section showing backrest has been adjusted to a maximum height.
Figure 5:
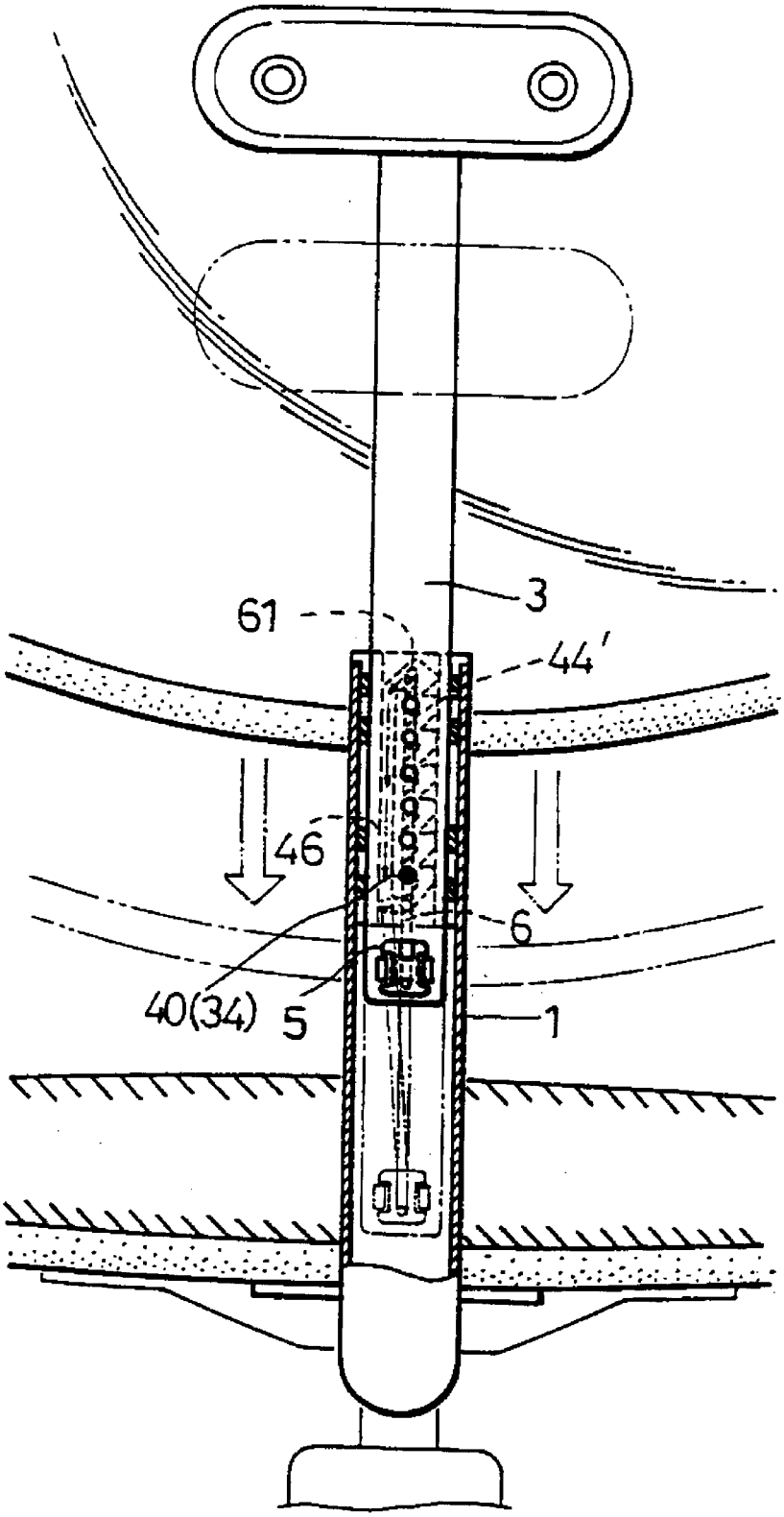
FIG. 5 is a view similar to FIG. 4 where backrest has been adjusted to a minimum height.

Referring to FIGS. 3 to 5, the operation of the height adjustment mechanism of the invention will now be described. As shown in FIG. 3, bent end 61 of hook member 6 is moveable around a loop formed by channel 46 and curved members of notched member 44'. When bent end 61 is in a lowest position (FIG. 4), user may push backrest 9 up to cause bent end 61 to move up along the curved members of hook member 44' and steel ball 403 to clear from recess 34 for disengaging second half-cylindrical member 4' from sliding member 3. Hence, it is possible of positioning bent end 61 in any one of stops 442 for obtaining a desired height of backrest 9. Wherein a portion of steel ball 403 falls into another recess 34 for engaging second half-cylindrical member 4' with sliding member 3 again. Alternatively, if the height of backrest 9 is not desired (e.g., a lower position is desired), user may first push backrest 9 up to cause steel ball 403 to clear from recess 34 for disengaging second half-cylindrical member 4' from sliding member 3 and bent end 61 to move up until reaching the topmost position. Then push backrest 9 down to cause bent end 61 to move through channel 46 until reaching the lowest position. Finally, push backrest 9 up to cause bent end 61 to move up along the curved members of hook member 44' so as to position bent end 61 in any one of stops 442 for obtaining a desired height of backrest 9. Wherein a portion of steel ball 403 falls into another recess 34 for engaging second half-cylindrical member 4' with sliding member 3 again. Similarly, if the height adjustment mechanism is mounted in an arm 8 the same operation may be performed for adjusting height thereof (FIG. 3).

While the invention herein disclosed has been described by means of specific embodiments, numerous modifications and variations could be made thereto by those skilled in the art without departing from the scope and spirit of the invention set forth in the claims.

What is claimed is:

1. An adjustment mechanism mounted in a chair for releasably locking one chair component in any one of a plurality of positions relative to a seat of said chair, said adjustment mechanism comprising:

a tube-like brace having one end secured to underside of said seat;

a sliding member slideable in said brace having an upper end secured to one chair component, a lower opening, and a plurality of longitudinally disposed recesses;

a guide member coupled to said lower opening of said sliding member;

a hook member having a lower end coupled to said guide member and an upper bent end;

a first half-cylindrical member secured in said brace including an internal notched member having a plurality of curved members each including a first curve, a stop, and a second curve, and a longitudinal channel in communication with said curved members; and a second half-cylindrical member secured in said brace matingly snapped with said first half-cylindrical member for receiving said sliding member and said hook member, said second half-cylindrical member including a lower hole, a spring-loaded detent having a portion projected from said lower hole into one of said recesses for engaging with said sliding member and other remaining portions concealed in said lower hole in an unused state of said adjustment mechanism, and a fastener secured in said lower hole to compress said spring-loaded detent;

wherein one chair component is operative to push down to cause said bent end to move through said channel in response to a disengagement of said detent from said recess and pull up to lock in one of said curved members with said detent engaged with one of said recesses.

2. The adjustment mechanism of claim 1, wherein said fastener is a thumb screw.

3. The adjustment mechanism of claim 1, wherein said detent comprises a steel ball releasably engaged with one of said recesses.

* * * * *